United States Patent [19]

Smolderen et al.

[11] 3,968,926

[45] July 13, 1976

[54] TEARSTRIP PACKAGE

[75] Inventors: Albert Emiel Smolderen, Aartselaar; Joseph Marie Cappuyns, Berchem, both of Belgium

[73] Assignee: AGFA-GEVAERT N.V., Mortsel, Belgium

[22] Filed: Oct. 26, 1973

[21] Appl. No.: 409,966

Related U.S. Application Data

[62] Division of Ser. No. 192,021, Oct. 26, 1971, Pat. No. 3,795,080.

[30] Foreign Application Priority Data

Oct. 26, 1970 United Kingdom ..... 50835/70

[52] U.S. Cl. ..... 229/66; 206/455; 206/498; 229/51 S

[51] Int. Cl.[2] ..... B65D 5/54

[58] Field of Search ..... 206/455, 454, 456, 498; 229/51 S, 51 TS, 51 AS, 66, 86

[56] References Cited

UNITED STATES PATENTS

| | | | |
|---|---|---|---|
| 2,274,278 | 2/1942 | Sanders | 206/455 |
| 2,816,701 | 12/1957 | Sisk | 229/86 |
| 3,094,269 | 6/1963 | Schneider | 229/51 S |
| 3,298,598 | 1/1967 | Eberstadt | 229/86 |
| 3,593,912 | 7/1971 | Collura et al. | 206/498 |

FOREIGN PATENTS OR APPLICATIONS

| | | | |
|---|---|---|---|
| 1,566,681 | 5/1969 | France | 229/66 |

*Primary Examiner*—George E. Lowrance
*Assistant Examiner*—Bruce H. Bernstein
*Attorney, Agent, or Firm*—William J. Daniel

[57] ABSTRACT

Hermetically sealed package for photographic sheet materials provided with one or two tearstrips which extend at the end of the package in the form of a loop. In order to facilitate the opening of the package in the dark a small part of the package is scored in the corners where the tearstrip extends, so that it can easily be torn off whereupon a sufficiently long extremity of the tearstrip is freed to open the package without difficulty.

3 Claims, 5 Drawing Figures

TEARSTRIP PACKAGE

This is a division of Ser. No. 192,021, filed Oct. 26, 1971, now U.S. Pat. No. 3,795,080.

The present invention relates to a packaging method for sheet material as e.g. photographic sheet material wherein at least one tearstrip is fitted at the innerside of the package.

A method for packaging photgraphic sheets is known comprising the steps of tightly enclosing the photographic sheets between two rectangular sheets of wrapping material cut from webs of such material, and securing the marginal portions of these sheets of wrapping material together, e.g. by adhesion or heat-sealing. A tearstrip which has been provided at the innerside of one longitudinal margin of the wrapping permits the easy opening of the package. Such a packaging method has been described in our U.S. Pat. No. 3,411,263.

The package can be opened by pulling away a corner of the wrapping at one extremity of the longitudinal margin where the tearstrip is provided. Since the tearstrip passes through such corner piece and is attached thereto, said corner piece provides for a firm hold when tearing up the longitudinal margin of the wrapping by means of the tear strip whereby a free access to the packaged sheets is obtained.

Such a known package suffers from the drawback that the location of the corner piece to be torn away may involve difficulties in identifying same when the package must be opened in the dark. Further, the common practice of incorporating aluminum foil in the packaging material increases the resistance to tearing of the package. In such occurrences one may have to revert to the use of a pair of scissors, in order to separate the corner piece from the package.

The object of the packaging method according to the present invention is to provide a package which can be opened in the dark in a simple way without any auxiliary means.

According to the present invention, a method for packaging sheets, wherein said sheets are packaged in packaging material which forms a wrapping round the sheets which is closed by flap portions at two opposite edges of the sheets, and wherein at least one tearstrip is inserted between the packaging material and the packaged sheets, said tearstrip extending from one flap portion to the other, is characterised in that a loop of said tearstrip is punched through one side of at least one of said flap portions. Preferred but optional features of the invention are as follows.

The tearstrip is adhered to the innerside of the packaging material before the sheets to be packaged are placed thereon, and the loop in the tearstrip is punched immediately before the tearstrip is adhered to the packaging material.

A slit is cut in a flap portion of the package at a location close to a tearstrip and at the side thereof remote from the edge of the package, the slit extending generally parallel to the tearstrip and having a length which is smaller than the width of the flap portion.

In the present specification the term "sheets" applies to one single sheet only, as well as to stacks of sheets. The sheets may be of light-sensitive material, such as photographic paper or film, and also of material for use in electrophotography, such as paper coated with a semi-conducting material, or even common paper.

The packaging material may be in the form of sheets, but the packaging material may also be in the form of webs onto which sheets or stacks of sheets to be packaged are placed in succession, and which are severed and sealed between the distinct sheets or stacks.

The invention will be described more in detail by way of an example with reference to the accompanying drawings.

Figure 1:
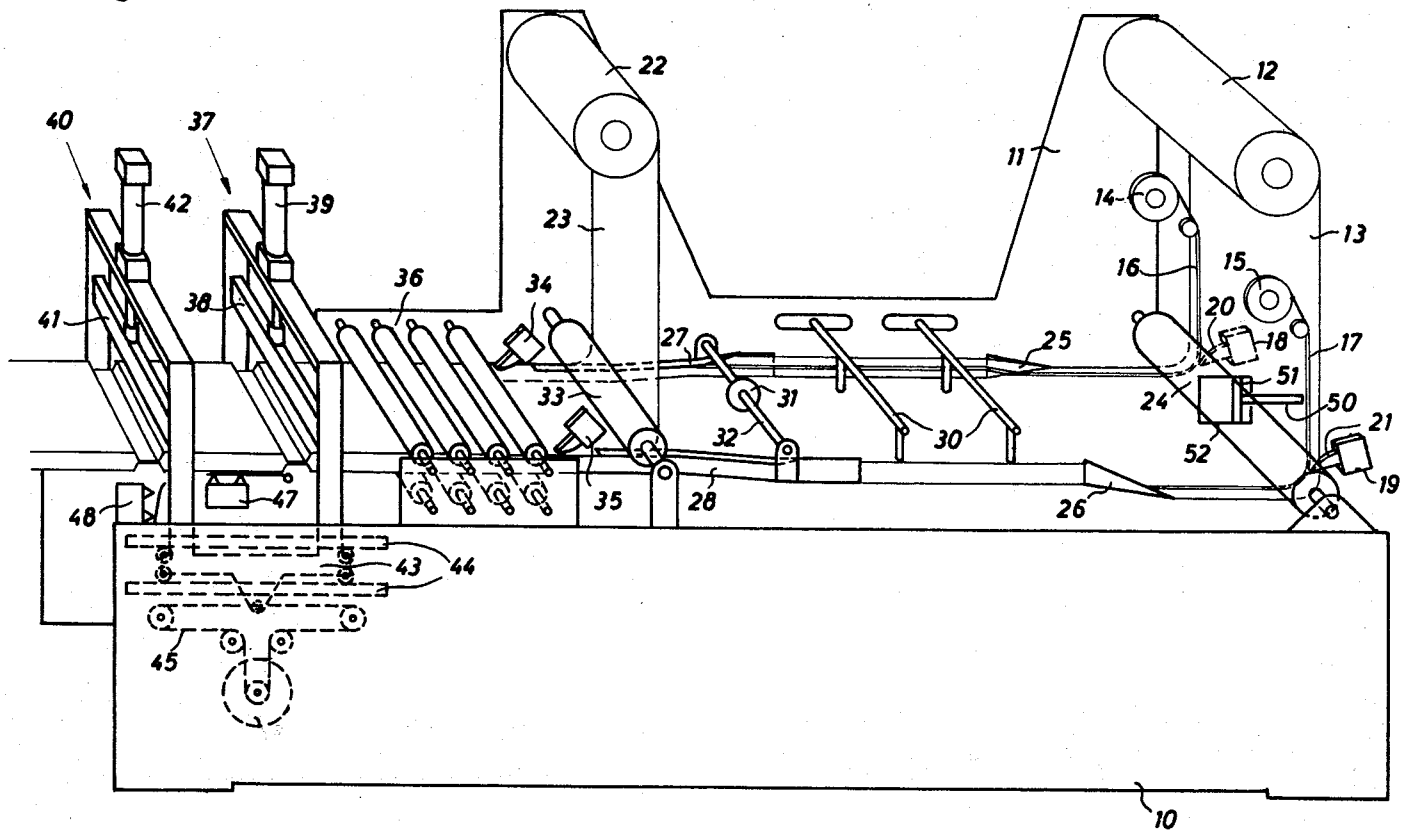
FIG. 1 is a diagrammatic view of an apparatus for continuous packaging stacks of photographic material.

The embodiment of FIG. 1 comprises a basic part 10, a support 11 mounted at one side on said basic part and several smaller supports at the opposite side on said basic part for supporting several parts of the apparatus.

The rollers 12 and 22 are freely rotatable and they bear cores onto which a first web 13 of wrapping material and a second web 23 of wrapping material, are wound respectively. Two rollers 14 and 15 are mounted so that they are freely rotatable and hold each a roll of small tapes 16 and 17, respectively.

Two welding means 18 and 19 comprise each an electric heating element which heats a metal core ending in the welding pins 20 and 21. Said pins exert a pressure on the side of the web 13 opposite to the side which, together with the tapes 16 and 17, is passed over the free-turning roller 24.

Between the roller 14 and the welding pin 20 and between the roller 15 and the welding pin 21 respectively a punch is fitted at either side of the web 13, as indicated by the numeral 50.

The punch 50 is attached to a piston 51 of a cylinder 52 and serves the purpose of simultaneously perforating the web 13 and pressing a loop of about 10 to 20 mm long in the tape 16 respectively 17 through the perforation 29 of the web 13. For the sake of clarity only one punching device is illustrated on FIG. 1. The shape of the punch is shown in more detail on FIGS. 2 and 3.

It can be seen that the first folding members 25 and 26 fold the margins of the web 13 upwardly over 90°. Second folding means 27, 28 fold the extremities of said upwardly folded margins again over 90° so as to locate them in a horizontal plane.

Stack positioning means is provided which is indicated by the numeral 30 and which in a known way comprises two parallel rows of vertical fingers which cyclically can approach horizontally to each other over a given distance and then remove vertically from the web, so as to properly align the sheets of the stacks, which the operator has placed on the web between the said fingers in the longitudinal direction of the web and to properly space the successive stacks on the web.

A roller 31 which is stationarily fitted on a free-turning shaft 32 presses on the central part of the stacks as they pass under it. The stacks are flexed thereby, since the upper side of the basic part 10 is progressively concavely curved in the transverse direction from behind the stack positioning means 30 up to the said roller 31, and the upstanding portions of the second folding members 27 and 28 slightly approach towards each other.

The second web 23 of wrapping material is passed over the free-turning roller 33 and it is applied with its margins onto the folded extremities of the margins of the first web.

The welding means 34 and 35, provided with welding pins similar to those of the welding means 18 and 19, exert a pressure on the margins of the web 23.

After said welding means 34, 35 the concavity of the upper side of the basic part 10 of the apparatus progressively diminishes, and at the place of the transport roller system 36, the said upper side has recovered into its flat form.

The roller system 36 comprises two horizontal rows of driven rollers which engage a wrapped stack at either side thereof in order to advance the webs at a uniform speed and to flatten the stack, thereby tensioning the wrapping around the stack.

The transverse sealing means 37 comprises an upper transverse sealing bar 38, moved by a pneumatic cylinder 39, and a cooperating lower sealing bar (not shown) which can approach towards each other and press onto each other in a plane which is located half the height of the wrapped stacks. In a known way the sealing bars are provided at their cooperating faces with an electrically heated flat resistance wire, which is covered with a strip of Teflon fabric (Teflon is a registered trade mark of E. I. duPont de Nemours & Co., Wilmington, Del., U.S.A.).

A transverse cutting means 40 comprises an upper severing knife 41 moved by a pneumatic cylinder 42 and a cooperating lower knife (not shown) which can approach towards each other so as to separate the successive packaged stacks.

Next to the transverse cutting means 40 an auxiliary cutter (not shown) may be mounted in such a way that a corner piece of the sealed part can be cut half-way close to the spot where the loop of one of the tapes 16 and 17 is pressed through the perforation to the outer side of the web 13 by means of the punch 50. The auxiliary cutter cooperates with the cutting means 40.

The sealing means 37 and the cutting means 40 are both mounted on a carriage 43 which is supported by guide rails 44. The carriage is cyclically moved to the left hand side, according to FIG. 1, at the speed of travel of the webs over a distance which is shorter than the distance between two successive stacks, and thereafter it is returned at increased speed to the right hand side, according to FIG. 1, in order to start a next cycle.

The said movements are imparted to the carriage by the chain 45 being cyclically driven by motor means in either direction. Motor means of the present kind are well-known in the art and have therefore not been represented here.

The operation of the apparatus for wrapping stacks of radiographic film sheets, each stack containing 125 sheets of NIF (non-interleaved film) film of 10 × 8 inches, a protective card-board sheet being provided at either side of the stack, will now be described.

The first web 13 has a width of 34 cm, the second web 23 has a width of 25 cm. Both webs are composed of three adhering superposed layers, viz. an opaque paper layer, an aluminium layer and a black polyethylene layer. Suchlike materials permit to package film sheets so that they are fully protected against moisture, chemical vapours and light. The web 13 is wound on the roll 12 the polyethylene layer at the inside, the web 23 is wound on the roll 22 the polyethylene layer at the outside.

The tapes 16 and 17 consist of a tough kind of paper, they have a width of 3 mm and a thickness of some tenths of a millimeter.

The webs 13 and 23 are continuously pulled from the rolls 12 and 22 by the driven rollers 36 being always in contact with at least one wrapped stack.

The operator places a stack of sheets on the advancing web 13 between the positioning means 30, the longitudinal direction of the sheets extending transversely of the web. The opposed transverse edges of the sheets engage the upstanding marginal portions of the web 13. The tapes 16 and 17 remain in place at the inside of the upstanding marginal portions of the web when inserting the stack since they have been secured to the polyethylene layer of the web 13 by means of the welding pins 20 and 21 which weaken the polyethylene layer and press the web against said tapes. The opposed longitudinal edges of the sheets of the stack are aligned by the stack positioning means 30 which after the aligning operation vertically remove from the web so as to let the stack pass by.

The stack of sheets is continuously advanced in flat condition by the web 13 until reaching the flexing roller 31. Immediately before this roller is reached the extremities of the upstanding margins of the web 13 have come into contact with the second folding members 27, 28 which progressively fold said extremities towards each other.

The lower part of the roller 31 extending beneath the top side of the stack engaging its periphery, causes the stack to flex so as to make it pass under the roller. The flexing of the stack is permitted by the concave upper side of the basic part 10 as described hereinbefore.

The flexing of the stack is assisted by the vertical portions of the folding members 27, 28 which slightly converge so as to exert pressure on the opposed edge faces of the stack.

When passing under the roller 33, the extremities of the margins of the first web 13 have been folded on top of the stack in one plane and the second web 23 is applied onto said folded extremities.

As the stack is still flexed, it passes under the sealing means 34, 35. Near its both extremities the web 23 is heated by the sealing means 34, 35 over a small path, so that its thermoplastic layer at the opposite side softens. Together with the pressure exerted by the sealing means, a tight joint is formed between the extremities of both webs. The tensioning of the webs in the longitudinal direction suffices to ensure a sufficient stiffness of the web portions between the successive stacks so that the webs are also well sealed to each other at those areas when passing under the sealing means 34, 35.

After said sealing means 34, 35 the concavity of the upper side of the basic part 10 gradually decreases, as mentioned already hereinbefore. When reaching the transport roller system 36 (in the drawing the distance between the sealing means 34, 35 and the roller system has been reduced considerably) the wrapped stack is flattened and the wrapping tensions around the stack.

When the wrapped stack is leaving the roller system 36, the last roller pair thereof still engaging the stack, then the carriage 43 has been located in the position most to the right according to the figure. A magnetic valve is opened, and air-pressure is admitted to the cylinder 39 so that the sealing bar 38 and the cooperating lower sealing bar approach to each other and weaken and seal the web portions extending just in front of the wrapped stack in a direction normal to that of the tearstrip. The opening of the valve may be triggered by sensing means 47 comprising a microswitch which is actuated by a lever, said lever being strongly biased so that the small roller, fitted at its extremity and running over the lower web, depresses slightly the web when a web portion between two successive stacks passes over it. Said roller is positioned at about 0.5 cm after the vertical plane through the two sealing bars, and as it depresses the web when rolling over the trailing edge of the preceding stack, the sealing bars seal the webs right in the middle of the spacing between said preceding stack and the following one.

At the moment the sealing means 37 was actuated, also the means driving the carriage was started and the carriage 43 moves to the left at a speed equal to that of the webs. The electric circuit of the magnetic valve controlling the cylinder 39 remains closed by a delaying relay so that when the small roller rolls on the following stack, the sealing means remains operative.

After moving over a distance of about five centimeters the carriage, by an upstanding leg, actuates the microswitch 48, the electric contact of which controls a magnetic valve in the air-pressure supply of the cylinder 42. The transverse cutting means 40 is operated and separates two successive packages. The closed contact of the microswitch 48 further energizes a relay which breaks the electric circuit of the magnetic valve controlling the cylinder 39 so that the transverse sealing means 37 becomes inoperative.

The mentioned relay also reverses the drive sense of the motor means driving the chain 45 and the carriage 43 returns to the right. The contact of the microswitch 48 re-opens whereby the transverse cutting means retakes its inoperative position. All these operations are performed within 1 second or so, so that the cutting means 40 only makes a quick cutting movement. When the carriage 43 has returned to the right, the mechanism is ready for being triggered by a next wrapped package.

The punch 50 punches the tapes 16 and 17 through the web 13 at a spot situated e.g. at a distance of about 10 mm from the place where the package is cut through by the cutting means 40. The width of the weld obtained with the sealing means 37 is thus defined that the perforation made by the punch in the web 13 through which the loop of the tape 16 respectively 17 is passing are located within the weld limits. In this way the tightness to air and to moisture of the package remain intact.

Figure 2:
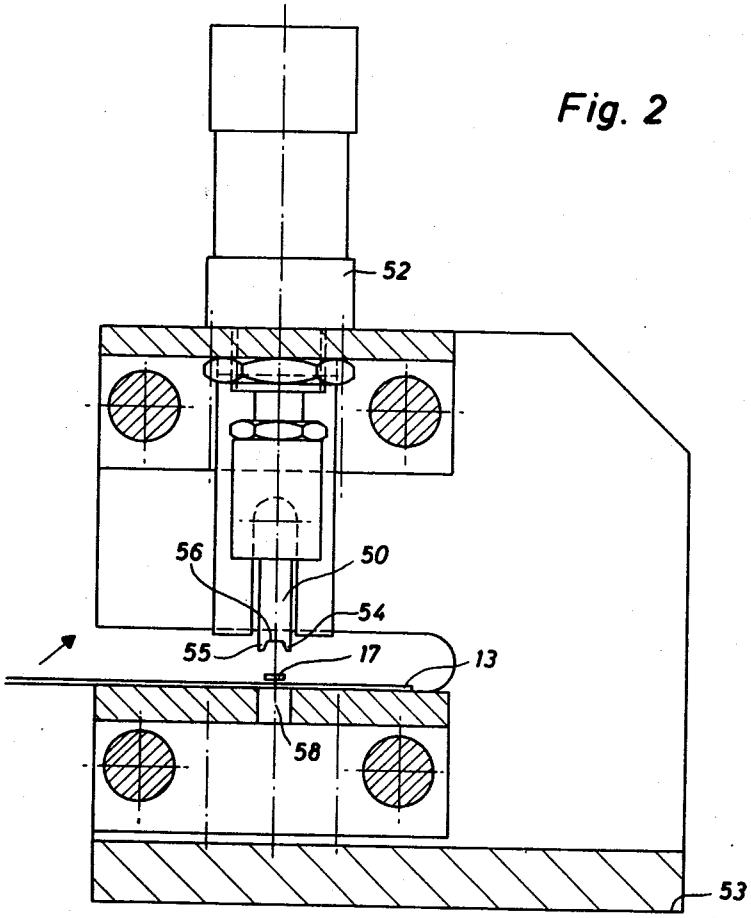
FIG. 2 shows a detail of the apparatus according to FIG. 1.
Figure 3:
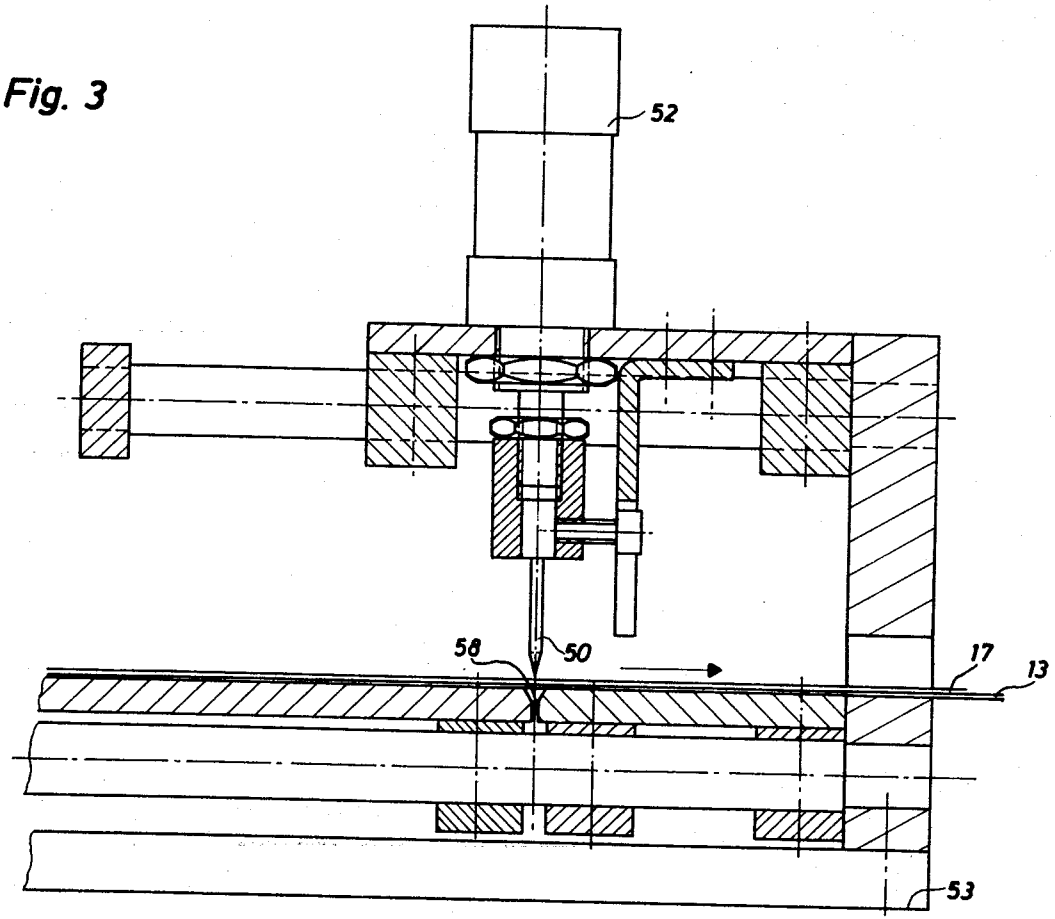
FIG. 3 is a lateral view of the detail of the apparatus according to FIG. 2.

FIGS. 2 and 3 illustrate respectively a more detailed lateral and transversal view of the punching device. Actuation of the punch 50 is obtained by admitting pressurized air pass into the cylinder 52, causing a piston located in the cylinder to move downwards and to perforate the web 13. This action is facilitated with the help of two tapered points 54 and 55. At the same time the stubbed part 56 between said points grips the tape 17 thus forming a loop in same in the hole 58 during a very short time lapse. The punching device is fixed on a support 53.

Figure 4:
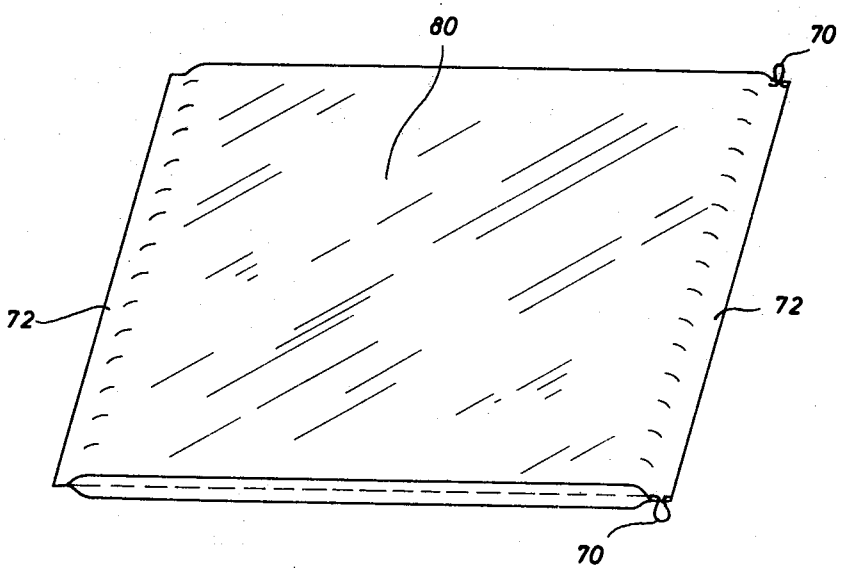
FIG. 4 shows a package produced according to the method of the invention.

A package 80 produced according to the present invention is shown in FIG. 4. At one end of both longitudinal sides the loop 70 formed by the perforation of the web 13 during the punching process emerges from the heat-sealed portion 72 at about 10 to 20 mm from the edge.

Figure 5:
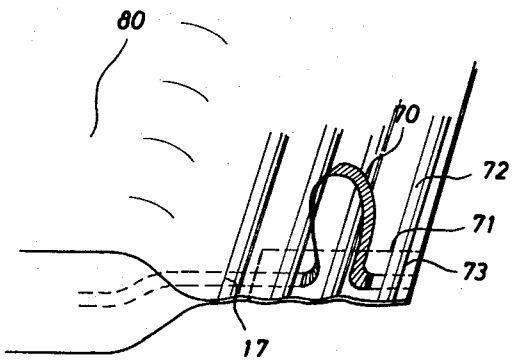
FIG. 5 illustrates more clearly a corner of the package of FIG. 4.

The structure of a corner is more clearly illustrated in FIG. 5. In the heat-sealed portion 72 of the package 80 a small portion 73 limited by the incision 71 is cut out to about half of the thickness without affecting however the light-tightness of the package.

The package according to FIG. 4 is opened as follows. The package is taken e.g. with the left hand and the half-way cut corner piece 73 at the right hand bottom place according to FIG. 5 is gripped with thumb and fore-finger of the right hand. The corner piece 73 is very easily torn off the package 80 by a simple separating movement of the hands.

In doing so a free extremity of the tape 17 is realized which is sufficiently long, which can be easily held and with which the bottom part of the package 80 (see FIGS. 4 and 5) can be opened without difficulty. Thereupon the operator can gently take the sheets of the photographic material out of the package.

The tearstrips 16, 17 may be applied at only one side of the stacks. Feeding means may be provided for feeding other strips, sheets or webs in the package, e.g. colour strips for characterizing the type of material contained in the package, thin lead foils in the packaging of single radiographic film sheets for use as intensifying screen, etc.

Finally, means may be provided for automatically feeding the sheets or the stacks of sheets to be wrapped successively onto the first web, so that the apparatus may operate completely automatically.

We claim:

1. A package comprising a wrapping of flexible sheet material sealed along side edges to form a flat tube and having the front and rear marginal strip portions transversally sealed together along end edges of said material, a tearstrip for opening said wrapping disposed lengthwise inside said wrapping with its ends embedded within the respective sealed together marginal strip portions, said tearstrip having a length exceeding the overall length of said wrapping to provide a reserve tearstrip length intermediate said embedded ends, a corner section of at least one of said sealed marginal portions which has the tearstrip end embedded therein being connected to the remainder of said marginal portion through a line of weakening, and an opening in said sheet material spaced from the end edges of said sealed material and adjacent said weakened corner section through which opening said reserve tearstrip length projects exteriorly in the form of a loop, whereby when said corner section is manually separated from said package along said line of weakening with the tearstrip end embedded therein, said reserve length is released permitting said corner section and tearstrip end to be firmly gripped by hand and pulled to sever said wrapper and open said package.

2. The package of claim 1, wherein said opening for said loop is within said sealed marginal portion and the tearstrip portions on either side of said loop are embedded with said sealed marginal portion.

3. A package comprising a wrapping of flexible sheet material overlappingly sealed along side edges to form a flat tube and having the front and rear marginal strip portions transversally sealed together, a tearstrip for opening said wrapping disposed lengthwise inside said wrapping with its ends embedded within the respective sealed together marginal strip portions, said tearstrip having between said embedded ends a length exceeding the overall length of said wrapping with the excess length of tearstrip projecting in loop fashion through an opening in one of said marginal strip portion, the tearstrip portions contigious to said projecting loop being embedded within said sealed marginal strip portion.

* * * * *